United States Patent [19]

Buck

[11] Patent Number: 4,850,854

[45] Date of Patent: Jul. 25, 1989

[54] CHILD RESISTANT CIGARETTE LIGHTER

[76] Inventor: George S. Buck, 223 Scott St., Memphis, Tenn. 38112

[21] Appl. No.: 103,663

[22] Filed: Oct. 2, 1987

[51] Int. Cl.[4] ..... F23Q 2/00

[52] U.S. Cl. ..... 431/143; 431/144; 431/255; 431/274

[58] Field of Search ..... 431/142, 143, 144, 151, 431/255, 274

[56] References Cited

U.S. PATENT DOCUMENTS

| | | | |
|---|---|---|---|
| 2,030,011 | 2/1936 | MacLennan . | |
| 2,199,885 | 5/1940 | Kravchuk . | |
| 2,240,678 | 5/1941 | Stanard . | |
| 2,459,656 | 1/1949 | Kirschner . | |
| 2,482,794 | 9/1949 | Peterson | 431/255 |
| 2,676,237 | 4/1954 | Tooker . | |
| 2,729,736 | 1/1956 | Perez . | |
| 2,902,579 | 9/1959 | Hutchinson . | |
| 3,098,923 | 7/1963 | Behrendt . | |
| 3,351,736 | 11/1967 | Jacobson . | |
| 3,354,291 | 11/1967 | Behrendt . | |
| 3,408,153 | 10/1968 | Ishiguro | 431/255 |
| 3,796,537 | 3/1974 | Lauri | 431/142 |
| 3,934,302 | 1/1976 | Mabuchi . | |
| 4,099,907 | 7/1978 | Fuller | 431/274 |

FOREIGN PATENT DOCUMENTS

| | | | |
|---|---|---|---|
| 1564840 | 3/1969 | France | 431/255 |

*Primary Examiner*—Samuel Scott
*Assistant Examiner*—C. B. Dority
*Attorney, Agent, or Firm*—David R. Murphy

[57] ABSTRACT

A child-resistant cigarette lighter having a cigarette well with a flame chamber near its bottom. Fuel and air are supplied to the flame chamber producing a combustible mixture which is then ignited, thereby producing a flame which is entirely confined to the well.

15 Claims, 7 Drawing Sheets

Figure 1:
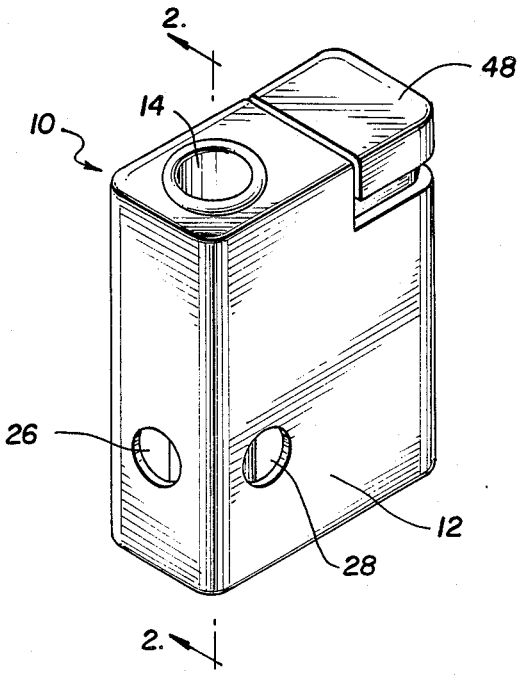

FIG. 9
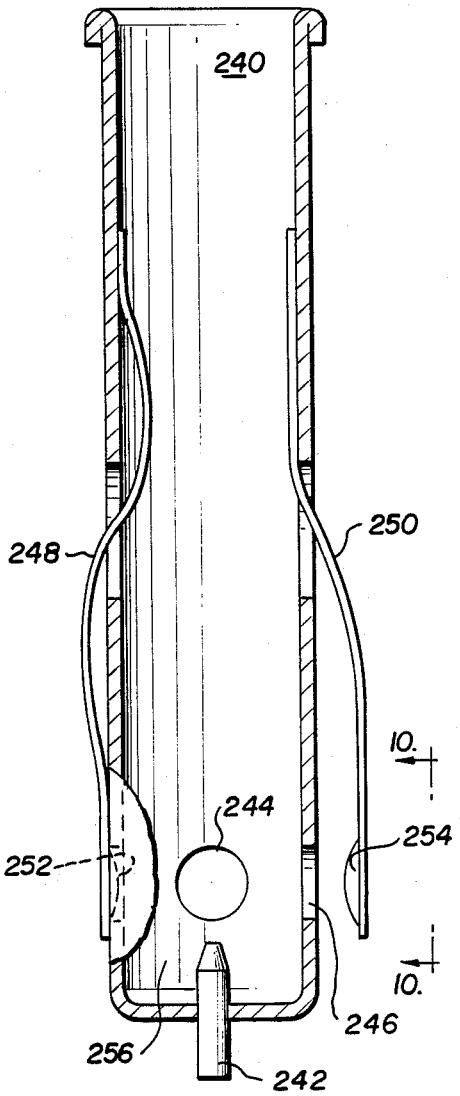
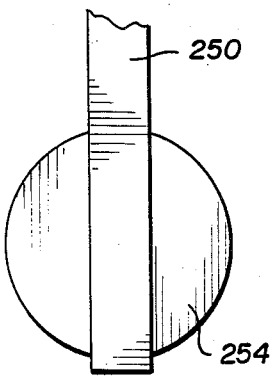
FIG. 10

CHILD RESISTANT CIGARETTE LIGHTER

Every year significant numbers of children in this country alone cause very serious burns to themselves or substantial property losses by igniting their clothing or other household products with cigarette lighters. Generally these lighters are the compressed gas type, usually using butane as a fuel.

Making cigarette lighters resistant to misuse by children would save scores, possibly hundreds of children from serious burn trauma accompanied by pain, suffering, and permanent scars. Even the accidents which happen to adults who carelessly ignite their clothing with cigarette lighters would be prevented. After considerable study I have discovered a way to make butane-type cigarette lighters not only highly resistant to abuse by children but almost totally fool proof against accidental misuse. It is this invention which I describe herein.

The child-resistant cigarette lighter which I have invented embodies several of the features of conventional butane-type cigarette lighters, including the following:

1. A chamber or reservoir of liquid butane under pressure.
2. A valving mechanism which, when manually actuated, usually by thumb pressure, permits the butane to be released through a small orifice, which is the burner.
3. A means of igniting the butane released through the orifice, usually with sparks created by a flint and a friction wheel, but sometimes by a piezo-electric spark.
4. An automatic gas cut-off for the butane which stops the flow of fuel from the orifice or burner when the thumb pressure is released.

Although some lighters have wind-shields and similar devices that partially screen the flame, all of them operate with an essentially open flame. This flame is sufficiently hot to ignite paper, textiles, some plastics, and many other materials within one or two seconds. Most clothing fabrics can be ignited with a butane lighter in less than two seconds.

The conventional cigarette lighter is easy to operate—so much so that children less than two years of age can often light them, and almost all children four years and older have no difficulty operating a butane lighter after observing its operation by others. When such lighters are left within the reach of children, usually in the absence of adult supervision, tragic fires often are the consequences.

It is an object of the present invention to provide an easy operating cigarette lighter of the compressed gas type (butane lighter) which embodies safety features that can reduce or entirely prevent the tragic injuries and even death that result from the use of the butane lighters by children, and even the careless use of such lighters by adults.

It is a further object of this invention to provide a child resistant cigarette lighter which is relatively inexpensive and which may be of the "disposable" type to help foster the widespread use of this safer lighter with consequent benefits to the public.

It is also an object of this invention to reduce the property damage and losses that frequently occur when butane cigarette lighters are the source of accidental ignition of combustible materials.

The child resistant or "safety" cigarette lighter which is the subject of this invention can be made to provide up to three levels of protection as follows: 1. The first level of protection derives from the elimination of an "open" flame, since in this safety cigarette lighter the flame is always at the end of a tube; 2. The second level of protection arises from a design which prevents ignition of the fuel (usually butane) unless the cigarette is filling the well or tube; 3. The third level of protection or safety stems from the design element which extinguishes the flame when the lighted cigarette is withdrawn from the well or tube.

A safety lighter which embodies only the cigarette well or tube concept represents a major improvement in the safety of cigarette lighters, and this novel design by itself is an important feature of this invention. Certain figures illustrate features of a lighter which provides greater safety simply through the location of the burner flame either at the bottom of a cigarette "well" or at the end of a cigarette "tube", which tube might be considered a horizontal well.

Figure 2:
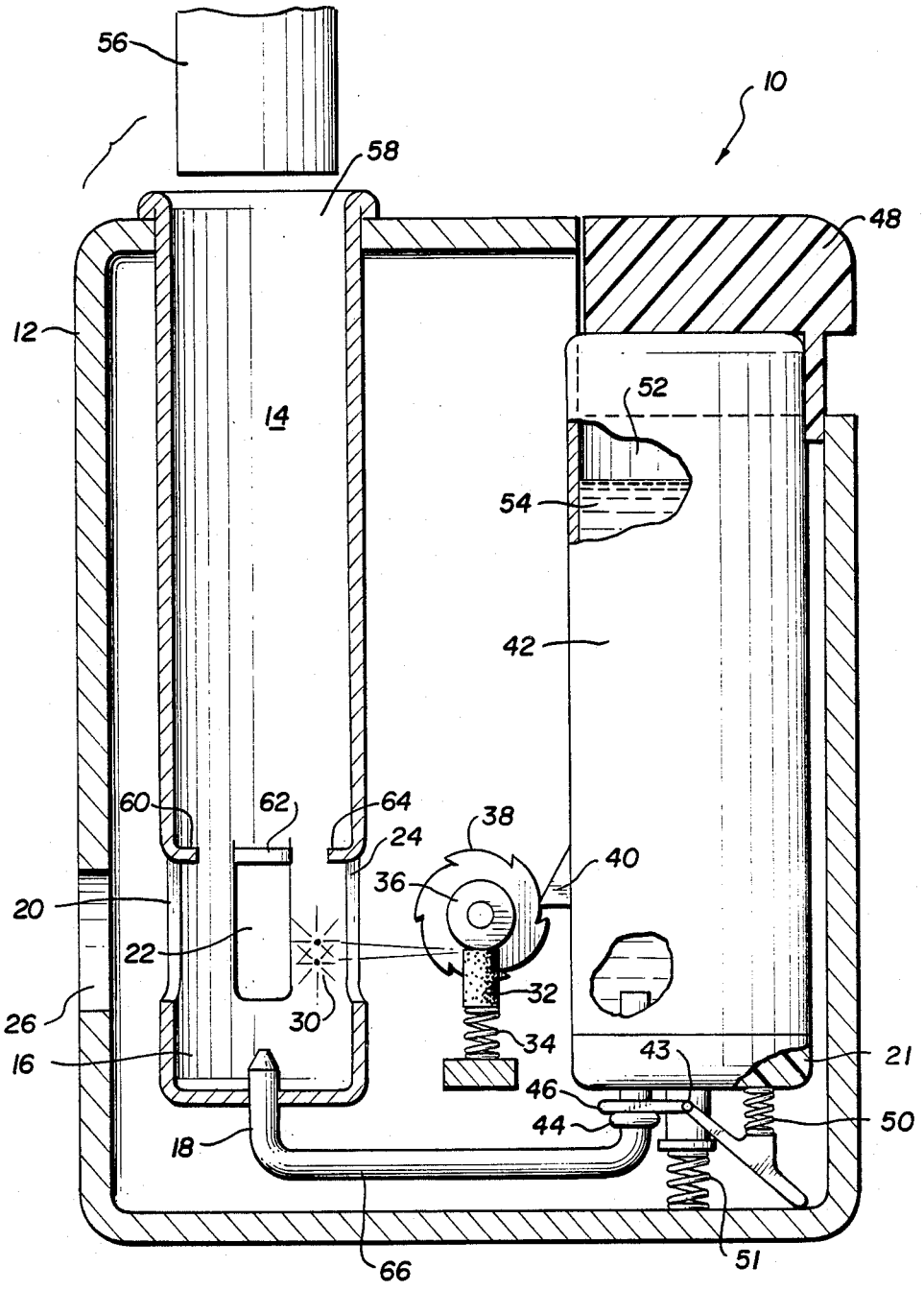
Figure 3:
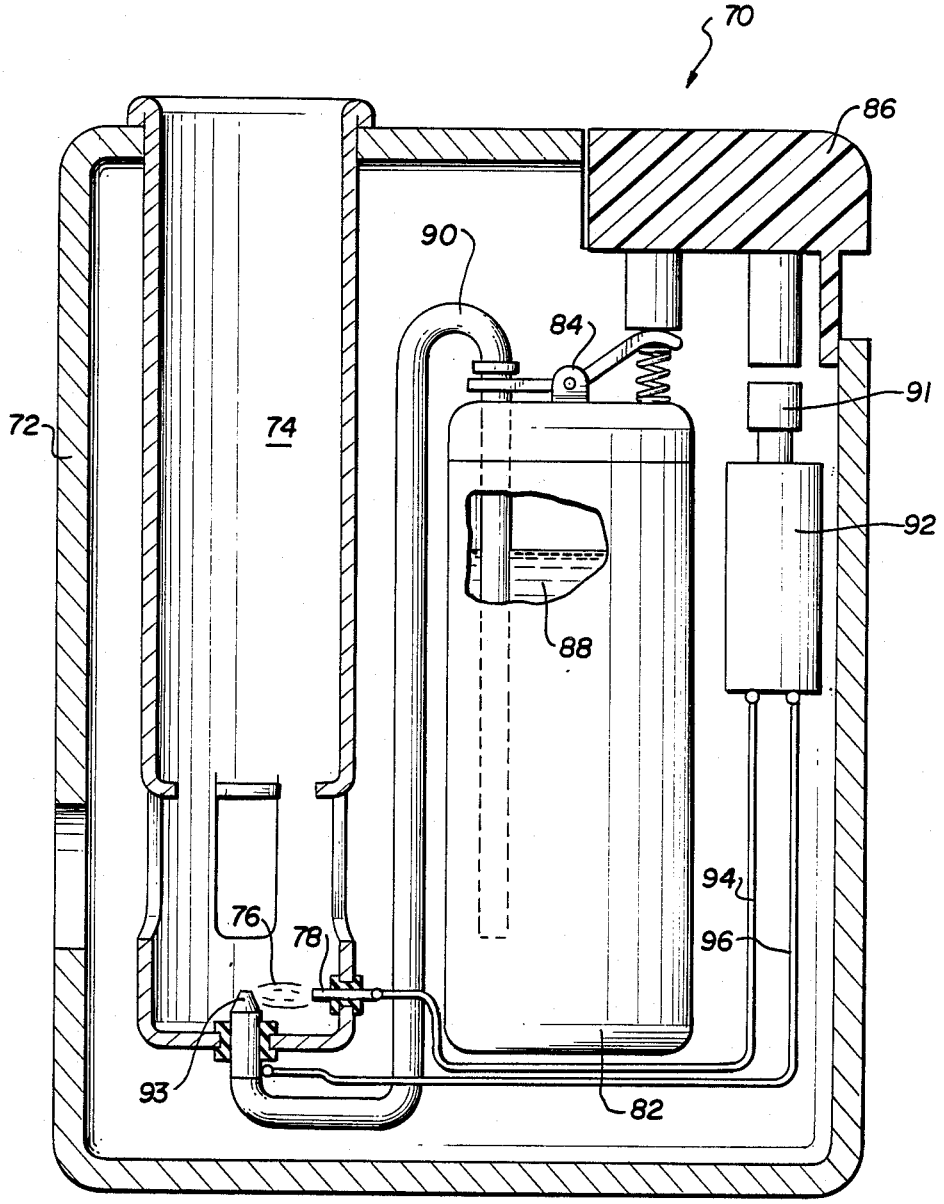
Figure 4:
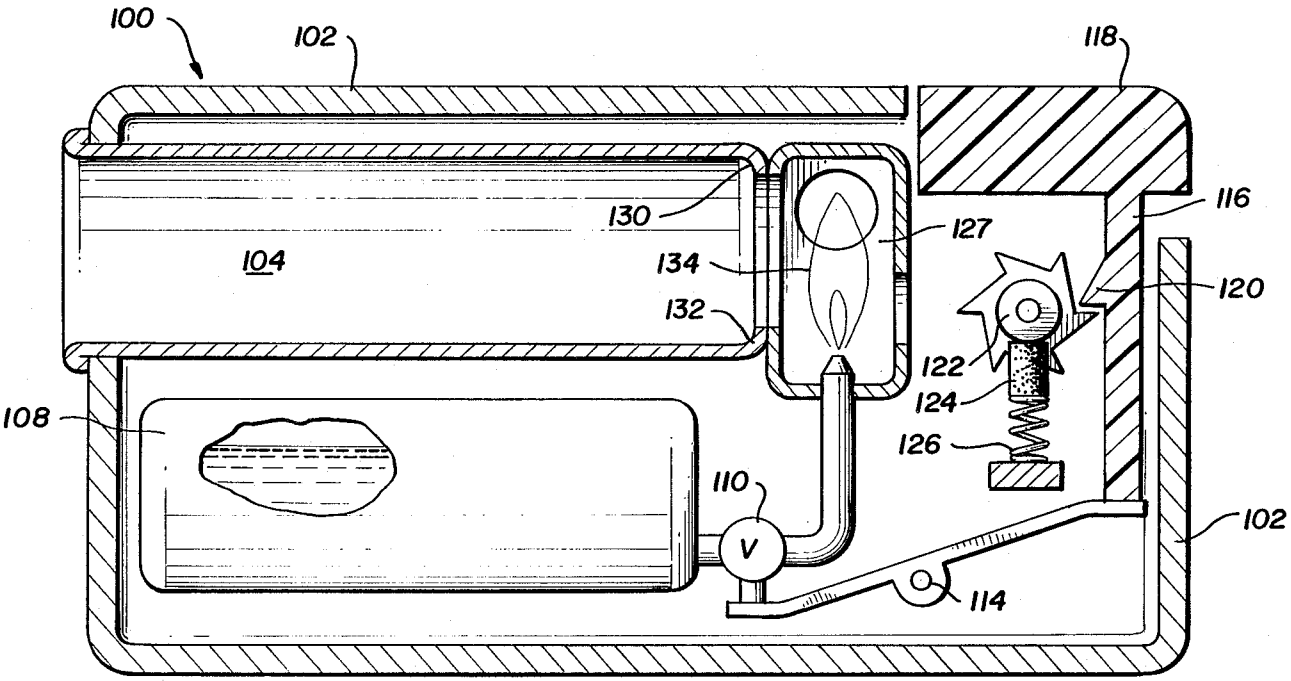
Figure 5:
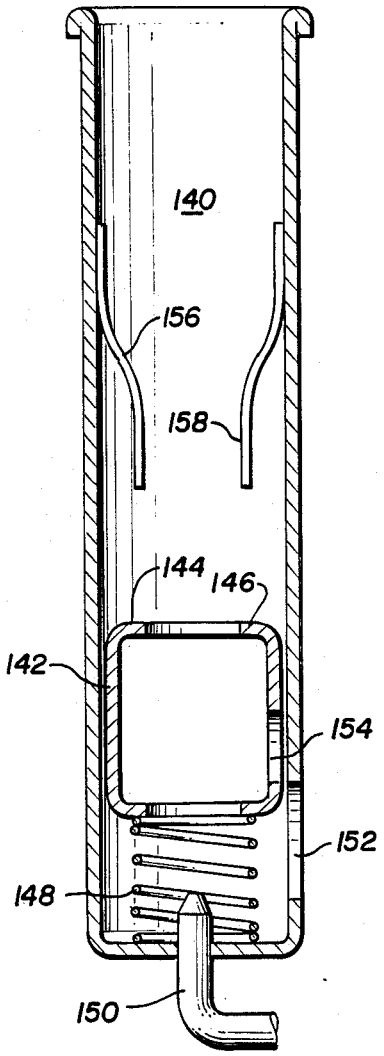
Figure 6:
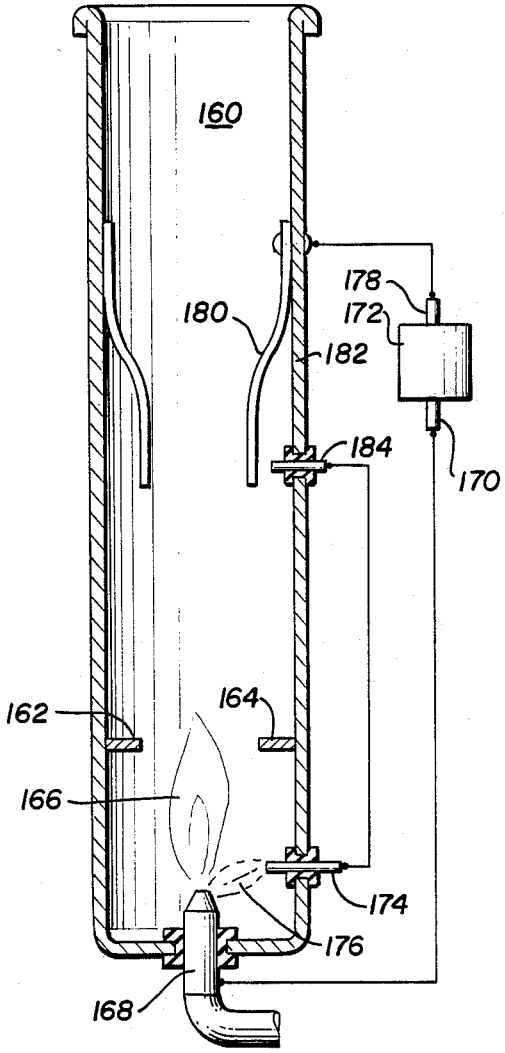
Figure 7:
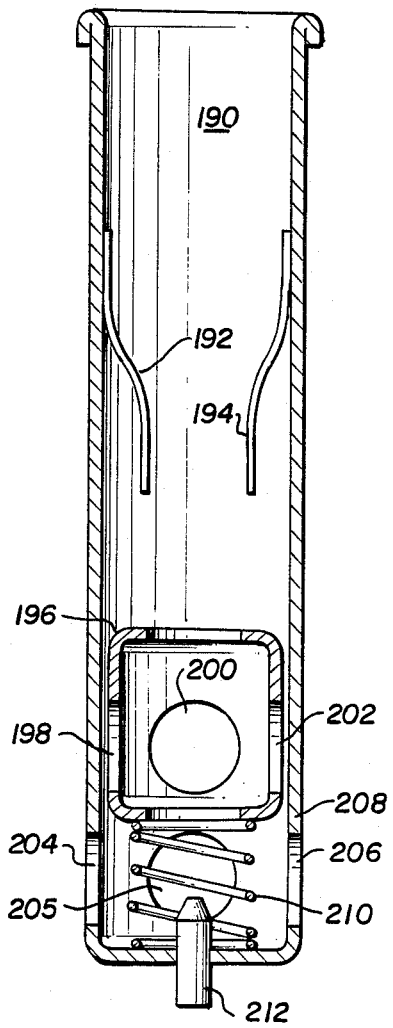
Figure 8:
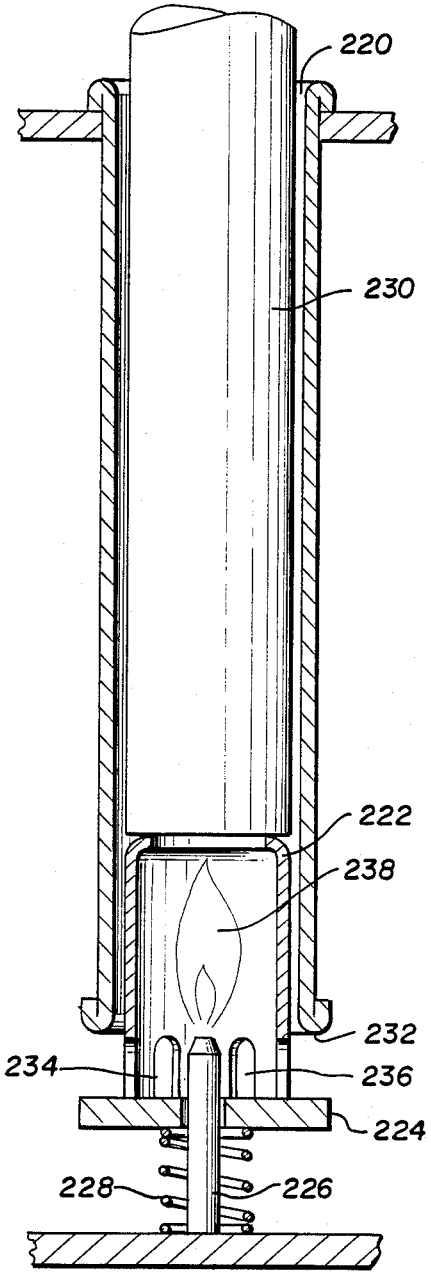

The invention may be better understood by reference to the following drawings wherein:

FIG. 1 is an isometric representation of a cigarette lighter of the present invention approximately full sized; and FIG. 2 is a greatly enlarged sectional view taken along the lines 2—2 of FIG. 1; and FIG. 3 is a greatly enlarged sectional view of an alternative embodiment of a lighter of the present invention having electric ignition; and FIG. 4 is a greatly enlarged sectional view of another alternative embodiment of a lighter of the present invention changed to be utilized in the horizontal position; and FIG. 5 is a greatly enlarged sectional view showing a modified well useful in a lighter of the present invention; and FIG. 6 is a greatly enlarged sectional view showing still another embodiment of the present invention; and FIG. 7 is a greatly enlarged sectional view showing yet another modified well useful in a lighter of the present invention; and FIG. 8 is a greatly enlarged sectional view showing an additional modified well useful in a lighter of the present invention; and FIG. 9 is a greatly enlarged sectional view showing one more modified well useful in the present invention; and FIG. 10 is an even more greatly enlarged partial view taken along line 10—10 of FIG. 9.

In accordance with the present invention there is provided a child-resistant cigarette lighter having fuel in a fuel tank, a way to supply that fuel to a flame chamber and mix the fuel with air to create a combustible mixture, and a way to light that combustible mixture plus certain additional important features. These features included a way to confine the flame to the bottom of the well. Some embodiments of the present invention incorporate additional safety features.

Referring now to the drawings in general and in particular to FIGS. 1 and 2 there is shown a cigarette lighter 10 having a level of protection which is dependent only on shielding the flame at the bottom of a cigarette well. The lighter 10 has a case 12 of convenient size just a little larger than that of a conventional cigarette lighter because of the cigarette well 14. At the bottom of the well 14 is the burner chamber 16 and the burner 18. Air vents 20, 22, 24 are placed around the burner chamber 16. The case 12 also has air vents 26, 28. The vent 24 may be slightly larger than the other vents as it provides the entry point for the igniting sparks 30 which are produced by contact of the flint 32, which has spring 34 and an abrasive wheel 36 and a ratchet wheel 38. That abrasive wheel 36 is forced to make a partial turn when a projection 40 on the fuel tank 42 presses against a ratchet of the ratchet 38 as the fuel tank 42 is pressed downward in the lighter 10 to open the fuel valve 44. The fuel valve 44 is opened in this safety lighter, using much the same mechanisms as commercial butane lighters, when a lever 46 pivotal at 43 opens the valve 44 by pressure as the button 48 moves the fuel tank 4z toward the bottom of the case 12 thereby moving the pivotal lever. The spring 50 which returns the fuel valve to a closed position may also be assisted by one or more additional springs 51 which restore the tank 42 to its original position after ignition is accomplished. The fuel tank 42 is, mounted as shown and suitably positioned in the lighter case by either chamber walls or positioning members, not shown. The volume of compressed gas 52 acts to expel the fuel, 54 usually butane, from the fighter 10 when the valve 44 has been opened. The fuel tank 42 is forced downward by the thumb pressure on the actuator 48 causing the valve 44 to open by forcing the pivotal arm 46 against the bottom of the case, as noted. The cigarette 56 is placed in the cigarette well 14 through the opening 58 until it reaches one or more projections 60, 62, 64 which hold the end of the cigarette 56 in the proper position for ignition. In this upside down position of the fuel tank 42 a plastic header in the tank 21 holds the fuel valve, fuel stem, and pivotal valve opener which when open allows the fuel to flow through the tube 66 to the burner tip where it vaporizes.

FIG. 3 illustrates another version which also has a single of level protection dependent on the use of a cigarette well. The lighter 70 has a case 72 and cigarette well 74 are similar to those of FIG. 20. However, the lighter 70 has a gap for an electric spark 76 to pass from a conductive terminal 78 to the burner 80. The fuel tank 82 has a valve 84 on the top, operated by thumb pressure on the actuator 86 so that the fuel 88 (generally butane) passes through the tube 90 to the burner 92. When the fuel valve lever pivotal at 84 is depressed by the actuator 86 also depresses the piston 91 of the piezo electric crystal device 92 which causes an electric current to flow through the wires 94 and 96 and to create a spark 76 across the gap between the conductor 78 and the burner 93 causing the butane to ignite.

In FIG. 4 the lighter 100 has a case 102 with a cigarette well 104 in a horizontal position, in which position it might be referred to a cigarette tube. The fuel tank 106 lies on its side with the gas phase 108 at the top and the butane valve 110 where shown. Control lever 112 rotateable about a pivot 114 is caused to open the gas valve 110 when depressed by the plunger 116 attached to the actuator 118. A projection 120 from the plunger 116 operates a friction wheel 122 against the flint 124. The flint 124 is upwardly biased by the spring 126. When rotated the flint 124 projects sparks into the flame chamber 127. In this embodiment any cigarette which projects into the cigarette well 104 to the stops 130, 132 must be ignited by drawing air and the flame 134 toward the cigarette end (not shown) by drawing through the cigarette. The flame 134 is entirely encased in the cigarette case 102 and provides the important protection associated with the elimination of an open flame.

The second level of protection which I have found may be built into a safety cigarette lighter is one which prevents ignition of the butane gas unless the cigarette is fully inserted in the cigarette well. This safety feature is illustrated in FIGS. 5 and 6.

FIG. 5 illustrates only the cigarette well 140 of the lighter type previously illustrated. At the bottom of the well 140 is an inner sleeve 142 whose top edges are either bent inward or have projections 144, 146 as cigarette stops. This sleeve 142 is mounted on a spring 148 around the burner 150 in such a way that the access hole 152 in the cigarette well 140 for the igniting spark (not shown) does not line up with a matching hole 154 in the moveable sleeve 142 unless the cigarette pressing against the projections 144, 146 moves the sleeve 142 downwardly so that the holes 152 and 154, are aligned. The flexible plastic or metal spring-like strips 156, 158 which may number from one to four or more, hold any cigarette in a light frictional grasp while it has the moveable sleeve 142 depressed against the spring 148. When the cigarette has been ignited and withdrawn from the cigarette well 140 the sleeve 142 moves back to its raised position so that the spark access holes 152, 154 are no longer aligned.

FIG. 6 illustrates a second method for preventing the ignition of the butane unless a cigarette is in place in the cigarette well. Only the cigarette well 160 and associated mechanisms are illustrated here. Inside the cigarette well 160 stops 162, 164 of any convenient design 2 position the cigarette (not shown) correctly above the igniting flame 166 which will be produced from the burner 168. The burner 168 is electrically connected to One pole 170 of an electric piezo sparking device, 172. A conductor 174 constituting the other end of the spark gap 176 is adjusted to the corrected distance from the burner 168 for a spark to be produced when the piezo electric crystal device 172 is actuated. The second pole 178 of the device 172 is attached to a flexible conductive strip 180 within the cigarette well 160 so that when a cigarette is inserted into the well 160 the flexible conductive strip 160 is forced outwardly toward the wall 182 of the cigarette well 160 making contact with the conductive pole 184. A spark 176 which jumps from conductor 174 the burner 168 will ignite butane flowing from the burner 168. FIGS. 5 and 6 illustrate only two methods of the second level of protection which may be provided to improve the safety of child resistant cigarette lighter. There are other ways to defeat ignition of the butane, and the principle illustration in FIGS. 5 and 6 is that the fuel may not be ignited in the safety lighter which is the subject of this invention unless a cigarette is in place in the cigarette well. These examples are not intended to be limiting on the principle involved.

The third level of safety which is provided by this invention involves the element of design which ensures that the butane flame will self-extinguish when the cigarette is removed from the cigarette well. I have discovered several ways for accomplishing this, but the most satisfactory methods appear to utilize mechanisms which simply cut off the air supply to the burner in the flame chamber. FIGS. 7, and 9 illustrate three non-limiting methods for achieving this third level of safety, namely burner flame self extinguishment.

FIG. 7 illustrates the cigarette well 190 only in which there are flexible strips 194 of plastic or metal designed to hold the cigarette gently but firmly in the well 190.

An interior sleeve 196, against which the cigarette may press, has air vent holes 198, 200, 202 which, when the well 190 is empty, are displaced from the corresponding air vent holes 204, 205, 206 in the cigarette well wall 208. This inner sleeve 196 is spring loaded against the bottom of the well 190 by spring 210. When any cigarette is inserted into the well 190 and placed against the slideable inner sleeve 196 that sleeve 196 can moved downwardly around the burner 212 until the air holes 198, 200, 202 in the sleeve 196 line up with the holes 204, 205, 206 in the well 190. In this position the burner 212 will receive enough air to ignite and to continue burning until the cigarette is removed from the cigarette well 190, at which point the spring loaded sleeve 196 will move upwardly once more, displacing the air vent holes and closing off the air necessary to sustain the burner flame.

FIG. 8 illustrates a second method for causing the flame to self extinguish after the cigarette is removed from the lighter. Once again only the cigarette well 220 is illustrated, with an inner open-structure sleeve 228 which in the empty position impinges the bottom of the cigarette well which is spring loaded against the well 220. In this position the cover 224 seals off the well 220 which has no air vents. The burner fuel is fed through the tube 226 as positioned inside the spring 228 which upwardly biases the cover 224. The cigarette well 220 is equipped with the flexible inner strips (not shown) which hold the cigarette in position when the cigarette 230 is inserted into the cigarette well 220 and presses against the sleeve 222, and the cover 224 move downwardly beyond the lower rim 232 of the cigarette well 220, thereby exposing air holes 234, 236 which provide ample air for establishment and maintenance of the burner flame 238 and for entrance of the igniting sparks (not shown). When the cigarette 230 is removed from the well 220 after ignition, the cover 224 is returned to its position against the bottom rim 232 of the well 220 where it closes off the air so that the flame 238 is quickly extinguished by the accumulation of non-combustible gases in the well bottom and the absence of oxygen.

Referring now to FIGS. 9 and 10 there is shown yet another embodiment of the present invention having an alternative means of extinguishing the flame upon removal of a cigarette. FIG. 9 shows only a well 240 having at its bottom a burner 242 and a plurality of holes 244, 246 which can serve as air vents. The well 240 is provided with a plurality of S-shaped springs 248, 250. Each spring carries a hole-cover 254. When no cigarette is in the well 240 the holes are all covered as shown by the hole-cover 252. When a cigarette is in the well all springs take the position of the spring 250. In this position the hole cover 2S4 is displaced from the hole 246 permitting air to enter the flame chamber 256 thus supplying oxygen to flame and maintaining it.

The term cigarette as used herein refers to all tobacco products commonly referred o as cigarettes including those of regular length and those having an extended length of approximately 100 mm. The term cigarette also means those products having a diameter of 7 to 8 mm as well as so-called slim cigarettes having a diameter of 6.5 to 7 mm.

A variety of fuels can be used in the lighter of a present invention. These are preferably hydrocarbons which are gases at standard temperature and pressure but which may be liquified by pressure. After liquefaction and in a container at normal temperatures the gas over the liquid in the fuel tank supplies the pressure which in turn serves to expel the fuel whenever the exit valve is opened. Example of such fuels include butane, pentane, propane, and even methane and ethane. However, butane has the best balance of properties needed for this type of lighter.

I claim:

1. A child-resistant cigarette lighter comprising:

A. a fuel tank; and

B. fuel within the fuel tank; and

C. means forming a cigarette well and a flame chamber, and means between said well and flame chamber for stopping a cigarette from entering said flame chamber;

D. means for supplying fuel from the fuel tank to the flame chamber; and

E. means for supplying air to the flame chamber for mixing with the fuel to produce a combustible mixture; and F. means for igniting the combustible mixture in the flame chamber thereby producing a flame which is essentially confined to the flame chamber.

2. The lighter of claim 1 in which the fuel is liquid butane under pressure.

3. The lighter of claim 1 further comprising means for preventing ignition of the fuel unless a cigarette is inserted in the well for a distance of approximately one inch.

4. The lighter of claim 1 in which the means for igniting the combustible mixture is a burner mechanism which includes a means of releasing the fuel to the burner with a valve which must be held in the open position with manual pressure.

5. The lighter of claim 1 in which the means for igniting the combustible mixture is an igniting mechanism which is a flint and frictional device that projects sparks into the flame chamber when the device is actuated.

6. The lighter of claim 1 the means for igniting the combustible mixture is an igniting spark produced by a piezo-electric crystal connected by wires respectively to the burner and to a second conductor placed close to but not touching the burner so that when the piezo electric crystal is put under strain a spark will be produced between said conductor and said burner.

7. The lighter of claim 1 further comprising means for extinguishing the flame whenever the cigarette is withdrawn from the well.

8. The lighter of claim 1 in which the means for igniting the combustible mixture is inoperative whenever there is no cigarette in the cigarette well.

9. The lighter of claim 1 further comprising a wire carrying an electric current and means preventing flow of current unless a cigarette fills the well to approximately the location of the cigarette stop.

10. The lighter of claim 6 including a spring-like strip which is pressed toward the side of the cigarette well by the insertion of a cigarette into the well, thus making and electrical connection that permits the piezo-electric current to flow and to spark at the burner when the piezo crystal is actuated.

11. The lighter of claim 10 in which the strip also carries a projection which acts as a cigarette stop to position the cigarette at the optimum distance into the well.

12. A child-resistant cigarette lighter comprising:

A. a fuel tank; and

B. fuel within the fuel tank; and

C. means forming a cigarette well and a flame chamber, and means between said well and flame chamber for stopping a cigarette from entering said flame chamber;

D. means for supplying fuel from the fuel tank to the flame chamber; and plying air to the flame chamber; and E. means for supplying air to the flame chamber for mixing with the fuel to produce a combustible mixture; and F. means for igniting the combustible mixture in the flame chamber thereby producing a flame which is essentially confined to the flame chamber; and G. means for preventing ignition of the combustible mixture unless a cigarette is present in the well.

13. A child-resistant cigarette lighter comprising;

A. a fuel tank; and

B. fuel within the fuel tank; and

C. means forming a cigarette well and a flame chamber, and means between said well and flame chamber for stopping a cigarette from entering said flame chamber; and D. means for supplying fuel from the fuel tank to the flame chamber and;

E. means for supplying air to the flame chamber; for mixing with the fuel to produce a combustible mixture; and F. means for igniting the combustible mixture in the flame chamber thereby producing a flame which is essentially confined to the flame chamber; and G. means for extinguishing any flame upon removal from the well of any cigarette present in the well.

14. A child-resistant cigarette lighter comprising:

A. a fuel tank; and

B. fuel within the fuel tank; and

C. means forming a cigarette well and a flame chamber, and means between said well and flame chamber for stopping a cigarette from entering said flame chamber; and D. means for supplying fuel from the fuel tank to the flame chamber; and E. means for supplying air to the flame chamber for mixing with the fuel to produce a combustible mixture; and F. means for igniting the combustible mixture in the flame chamber thereby producing a flame which is essentially confined to the flame holder; and G. means for preventing ignition of the combustible mixture unless a cigarette is present in the well; and H. means for extinguishing any flame upon removal from the well of any cigarette present in the well.

15. A child-resistance cigarette lighter comprising:

A. a case; and

B. a fuel tank within the case; and

C. fuel within the fuel tank; and

D. a circular, cigarette well opening through the case; and 1. constituting means for receiving a cigarette; and
2. having an inside diameter only slightly greater than the outside diameter of a cigarette; and
3. having flame-permeable stops near its bottom; and E. A flame chamber below the bottom of the well; and F. Means for supplying fuel from the fuel tank to the flame chamber; and G. Means for supplying air to the flame chamber; and H. Means for mixing the fuel and air in the flame chamber to produce a combustible mixture; and I. Means for igniting the combustible mixture in the flame chamber thereby producing a flame which 1. is principally contained within the flame chamber; and
2. passes through the bottom of the well to ignite any cigarette in the well; and
3. is entirely confined to the case; thereby igniting a cigarette without permitting contact between the flame and any portion of an operator's person or clothing.

* * * * *